US009637969B2

(12) United States Patent
Wild et al.

(10) Patent No.: US 9,637,969 B2
(45) Date of Patent: May 2, 2017

(54) INTEGRATED WINDOW REGULATOR ASSEMBLY

(71) Applicant: HI-LEX CONTROLS, INC., Rochester Hills, MI (US)

(72) Inventors: Brian J. Wild, Ferndale, MI (US); Kevin Koneval, Macomb, MI (US)

(73) Assignee: Hi-Lex Controls, Inc., Rochester Hills, MI (US)

( * ) Notice: Subject to any disclaimer, the term of this patent is extended or adjusted under 35 U.S.C. 154(b) by 421 days.

(21) Appl. No.: 14/454,171

(22) Filed: Aug. 7, 2014

(65) Prior Publication Data

US 2016/0040746 A1 Feb. 11, 2016

(51) Int. Cl.
*E05F 11/48* (2006.01)
*E05F 15/689* (2015.01)
*E05F 7/04* (2006.01)

(52) U.S. Cl.
CPC ..... *E05F 15/689* (2015.01); *E05F 7/04* (2013.01)

(58) Field of Classification Search
CPC ..... F16F 15/067; F16F 2236/04
USPC ..... 49/348, 349, 352
See application file for complete search history.

(56) References Cited

U.S. PATENT DOCUMENTS 1,384,506 A 7/1921 Blackmore
1,734,555 A 11/1929 Bennett
4,235,046 A 11/1980 Hess et al.
4,274,300 A 6/1981 Golobay
4,313,282 A * 2/1982 Hagemann ..... E05F 11/485 49/352
4,657,523 A 4/1987 Chevance et al.
4,753,124 A 6/1988 Chevance
4,798,100 A 1/1989 Baumgarten
5,724,858 A * 3/1998 Polando ..... F16C 1/14 188/67
5,749,174 A 5/1998 Mariel
5,924,245 A * 7/1999 Manuel ..... B60J 5/0416 49/352

(Continued)

FOREIGN PATENT DOCUMENTS

DE 3737733 C1 * 5/1988 ..... E05F 11/485
DE 3925864 * 8/1990

(Continued)

*Primary Examiner* — Jerry Redman
(74) *Attorney, Agent, or Firm* — Brinks Gilson & Lione

(57) ABSTRACT

A rattle mitigation assembly for a window regulator installed in a vehicle door includes drive unit housing having a port with a mouth of a cylindrical cavity adapted to receive a connector of a sheathed cable; a profiled end face extending around the mouth; and a slot extending radially outward from the cylindrical cavity, along the cylindrical cavity and through the end face. The end face forms a radially sloped ramp profile configured to exert a radial bias on a compression spring surrounding the connector and abutting the end face. An optimal slope angle of the ramp for urging the spring in the radial direction lies in the range of 45° through 80° with respect to a plane extending radially relative to the cylindrical cavity. An optional wedge profile with an increasing elevation along a direction away from the radially sloped ramp profile may be arranged opposite the ramp profile to exert an axial bias on the compression spring.

13 Claims, 3 Drawing Sheets

(56) References Cited

U.S. PATENT DOCUMENTS

| | | | | |
|---|---|---|---|---|
| 5,950,365 | A * | 9/1999 | Lieb | B60J 1/17 49/28 |
| 6,012,201 | A | 1/2000 | Mitts et al. | |
| 6,131,482 | A | 10/2000 | Klippert et al. | |
| 6,193,621 | B1 * | 2/2001 | McClosky | F16C 1/22 474/101 |
| 6,202,351 | B1 * | 3/2001 | Medebach | E05F 11/485 49/352 |
| 6,866,250 | B2 | 3/2005 | Kita | |
| 7,325,360 | B2 | 2/2008 | Mazouzi et al. | |
| 7,472,515 | B2 | 1/2009 | Mazouzi et al. | |
| 7,669,501 | B2 | 3/2010 | Rothe | |
| 8,066,320 | B1 | 11/2011 | Grabowski | |
| 8,209,907 | B2 * | 7/2012 | Kinoshita | B60J 1/17 49/352 |
| 8,943,750 | B2 * | 2/2015 | Twork, Jr. | E05F 11/385 49/352 |
| 2005/0016070 | A1 * | 1/2005 | Cardine | E05F 11/485 49/352 |
| 2007/0180773 | A1 * | 8/2007 | Fortin | E05F 11/485 49/352 |
| 2009/0090065 | A1 | 4/2009 | Kinoshita et al. | |
| 2010/0043295 | A1 * | 2/2010 | Barr | E05F 11/485 49/352 |
| 2014/0115969 | A1 * | 5/2014 | Wei | E05D 13/00 49/352 |

FOREIGN PATENT DOCUMENTS

| | | | |
|---|---|---|---|
| DE | 101 38 397 | A1 | 8/2001 |
| DE | 20 2004 015 455 | U1 | 10/2004 |
| DE | 10 2011 011 948 | A1 | 2/2011 |
| JP | 06167168 | A * | 6/1994 |
| JP | 2009144424 | | 6/1997 |
| JP | 2003293651 | | 10/2003 |
| WO | 2005/078219 | A1 | 2/2005 |
| WO | 2008/099860 | A1 | 2/2008 |

* cited by examiner

INTEGRATED WINDOW REGULATOR ASSEMBLY

FIELD OF THE INVENTION

The claimed invention relates to a to a window regulator assembly used to open and close a window in a side door module. In particular, the claimed invention relates to an assembly of a spring cap and a drive unit housing of a window regulator.

BACKGROUND OF THE INVENTION

Motor vehicles generally feature side door windows which can be moved between lower (opened) and upper (closed) positions. The mechanism used to move the window between these upper and the lower positions is generally known as a window regulator. A window regulator is arranged inside a vehicle door below the window opening. The window regulator can either be manually operated by a person or driven by a powered actuator, most commonly an electric motor.

One type of window regulator utilizes a pulley system. This pulley system uses a metal cable guided around a drum coupled to an electric motor or hand crank to drive a carrier that is fastened to the window and engages a guide rail to control motion as the carrier moves vertically. The drum is rotatably mounted to a drive unit housing. In order to remove slack in the metal cable outside the drive unit housing, the cable extends through a cable sheath. The sheath terminates in a connector with a compression spring, also called spring cap. The connector is inserted into a corresponding port in the drive unit housing so that the compression spring is operatively arranged between the connector and the port. The compression spring takes up slack of the cable forming the core of the cable sheath and, due to its compressibility, reduces cable tension during operation of the window regulator when the cable is moving.

The use of sheathed cables has eliminated the need for a straight, tensioned cable path because sheathed cables, also called Bowden cables or push-pull cables, have the advantage of retaining the cable tension around bends. It has been found, however, that such a bent sheathed cable may vibrate when the door is slammed shut due to the added degree of freedom of the cable to swivel about the axis intersecting the connectors at the ends of the sheathed cable. The movement of the cable results in a rattle noise that is generally perceived as unpleasant and may convey a false impression of loose parts.

Therefore, it is desirable to mitigate the rattling noise caused by the bent sheathed cable.

SUMMARY OF THE INVENTION

One objective of the claimed invention is to provide an improved window regulator assembly that reduces the perception of rattling noises originating from the vibration of a sheathed cable inside a vehicle door. A further objective of the claimed invention is to shorten the duration of vibration to a time interval that is short enough not to be negatively perceived as an undesirable rattle sound.

It has been found that the rattle sound originates from the spring cap. Thus, it has been discovered that the objectives can be achieved by a drive unit housing that includes a port with a mouth of a cylindrical cavity adapted to receive a spring cap of a sheathed cable, and a profiled end face extending around the mouth. The end face forms a radially sloped ramp profile configured to exert a radial bias on the compression spring of the spring cap surrounding the connector of the spring cap and abutting the end face. The radially sloped ramp exerts an asymmetrical bias on the compression spring and thus urges at least a portion of the spring windings of the compression spring against the connector, either by pushing the terminal winding of the spring toward the cylindrical portion of the connector, or by pulling the terminal winding away from the connector and thus pulling the radially opposite side of the spring winding toward the connector. The asymmetrical bias significantly shortens the duration of any vibrations of the metallic compression spring that are perceived as rattling. Notably, the duration of the vibration is shortened to such an extent that the remaining vibration is perceived as part of the door slamming noise, not as rattling.

The port may further include a slot extending radially outward from the cylindrical cavity, along the cylindrical cavity and through the end face for facilitating the insertion of the cable core wire into the drive unit housing. The ramp profile is preferably arranged radially opposite the slot.

An optimal slope angle of the ramp for urging the spring in the radial direction lies in the range of 45° through 80° with respect to a plane extending radially relative to the cylindrical cavity.

For maximizing the rattle mitigation, the radially sloped ramp profile may extend in a circumferential area of the profiled end face that faces inboard of outboard with respect to the vehicle door. The direction of the radial bias thus coincides with the direction, in which the door moves during opening and closing.

The radial bias may be a radially inward bias with respect to the cylindrical cavity, and the ramp may have a ramp surface shaped as a segment of a funnel.

In order to ensure the effect of providing a radial bias on the spring, the ramp preferably extends over an angular range of at most 120° around the mouth.

According to a further aspect of the invention, the profiled end face may further include a wedge profile exerting an axial bias on the compression spring. While the term "wedge" is used in this context, the term is intended to include differently shaped protrusions extending from the end face. The wedge profile may have an increasing elevation along a direction away from the radially sloped ramp profile. In one embodiment, the wedge profile is symmetrically arranged bilaterally of and adjacent to the slot.

In order not to interfere with the function of the ramp profile, the wedge profile extends over an angular range of at most 180°.

The wedge profile has a wedge angle in a range of 5° through 30° with respect to a radial plane. Thus the wedge angle is smaller than the ramp angle.

Further details and benefits of the claimed invention will become apparent from the description of the accompanying drawings. The specific examples shown in the drawings are intended for purposes of illustration only and are not intended to limit the scope of the claimed invention.

BRIEF DESCRIPTION OF THE DRAWINGS

The drawings described herein are for illustrative purposes only and are not intended to limit the scope of the claimed invention in any way.

DETAILED DESCRIPTION

The following description is merely exemplary in nature and is in no way intended to limit the claimed invention or its application or uses.

Figure 1:
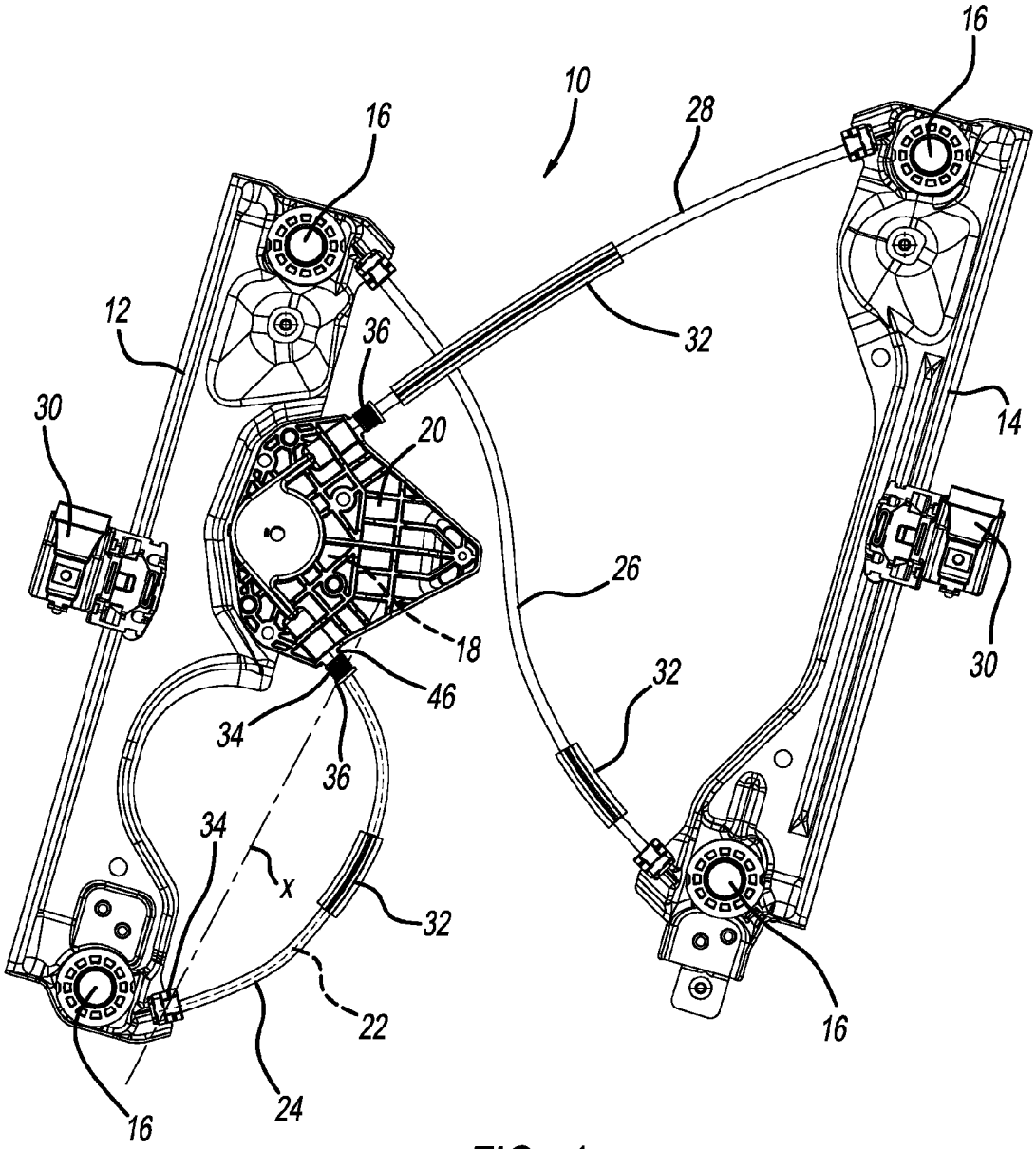
FIG. 1 is a perspective view of a of a window regulator assembly in accordance with this invention.

In FIG. 1, the components of a window regulator assembly 10 are shown. The window regulator assembly 10 shown in FIG. 1 includes a front window run channel 12, a rear window run channel 14, pulleys 16, a drive unit 18 in a drive unit housing 20, cable wire 22, cable sheaths 24, 26, and 28 around the cable wire in sections, in which the cable wire is not guided in the window run channels 12 and 14 or in the drive unit 18, and further window carrier brackets 30 driven by the cable wire 22 along the window run channels 12 and 14. The window regulator assembly is installed in a manner that the vehicle door extends in the image plane of FIG. 1. The outboard side of the vehicle door lies below the image plane, and the inboard side of the vehicle door lies above the image plane.

While cable sheaths 26 and 28 provide the flexibility of guiding the cable wire 22 along a curved path while maintaining the tension of the cable wire, they are optional and may be omitted. In that case, the cable wire 22 would be tensioned along straight lines in the locations of the cable sheaths 26 and 28. Cable sheaths 24, 26, and 28 are further surrounded by optional external padding 32 along a portion of their lengths to mitigate noise upon contact with other vehicle parts during movements of the door or the vehicle. In particular, cable sheath 24 describes an arc between it fixed ends 34 so that it may cause rattling by pivoting about the axis X extending through the fixed ends 34.

Each of the cable sheaths 24 and 28 attached to the drive unit housing 20 includes a spring-loaded connector 36 attached to the drive unit housing 20 for maintaining tension in the cable wire 22. The connector 36 and its attachment to drive unit housing 20 is shown in more detail in FIGS. 4 and 5, where for simplicity the cable core, formed by cable wire 22 axially extending through the connector 36, has been omitted.

Figure 5:
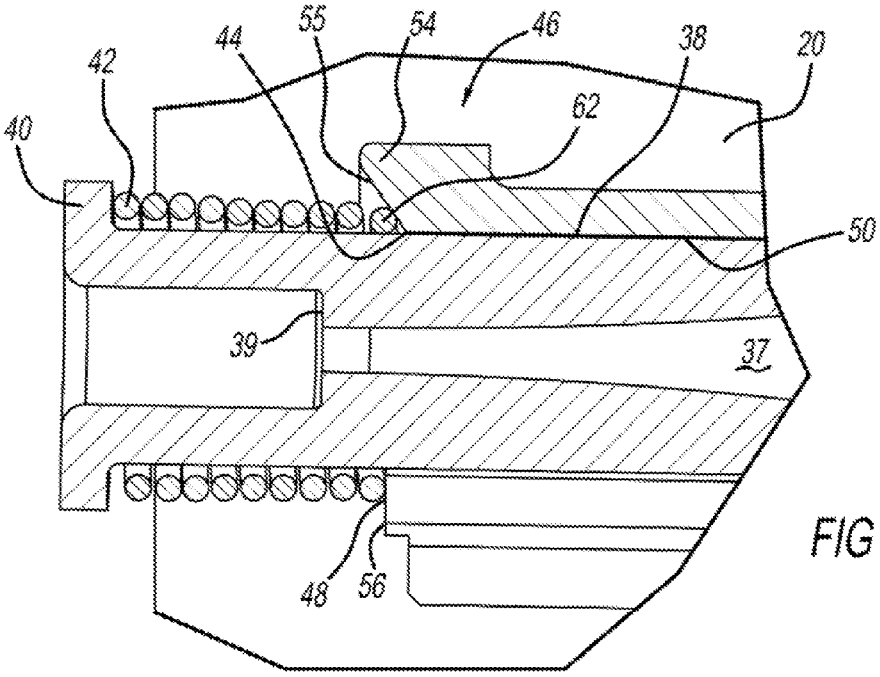
FIG. 5 is a cross-sectional view of the detail shown in FIG. 4.

As particularly evident from FIG. 5, the connector 36 has a circumferential, generally cylindrical surface 38, also called cylindrical portion hereafter, terminated by a radial collar 40 that serves as an abutment for a cylindrical compression spring 42 that surrounds the cylindrical surface 38 between the collar 40 and a mouth 44 of a port 46, into which the connector 36 is inserted with the cylindrical surface 38 at an end opposite the radial collar 40. The term "cylindrical" is being used in this context in an expansive meaning as including frustoconical shapes. On the inside, the connector 36 has an axial channel 37 that includes a radial step 39 widening the inner diameter of the axial channel 37 toward the collar 40 for providing an abutment shoulder for the cable sheath 24 or 26.

Figure 2:
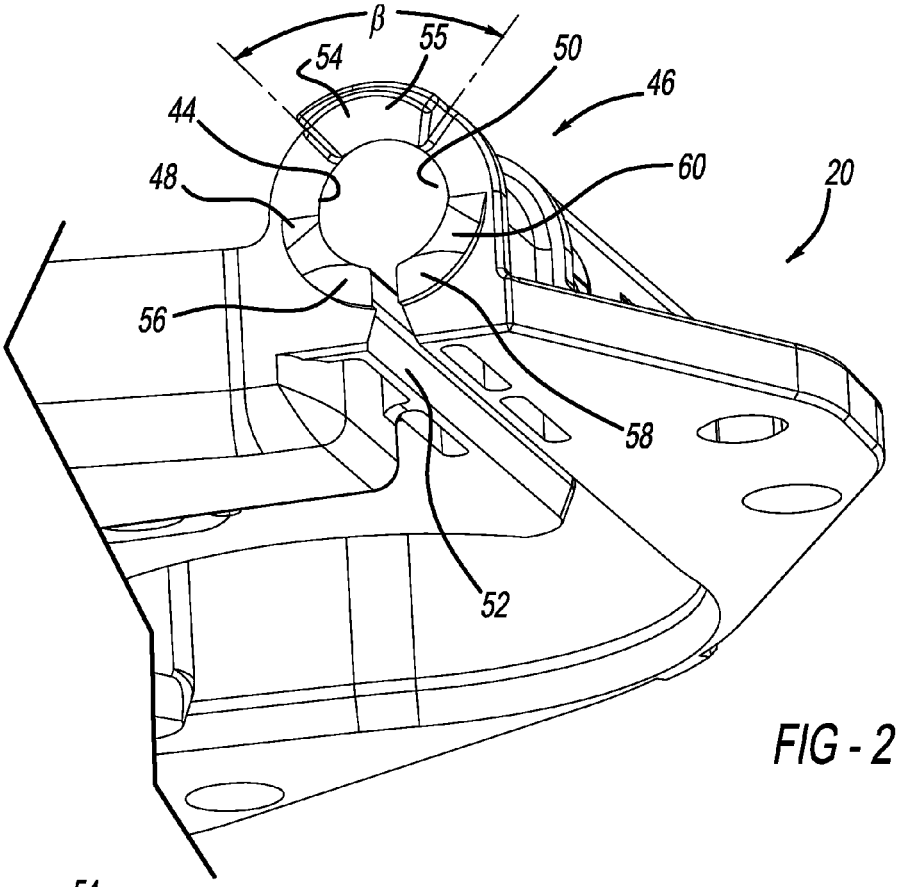
FIG. 2 is a perspective partial view on a detail of a drive unit housing of the window regulator assembly of FIG. 1.
Figure 3:
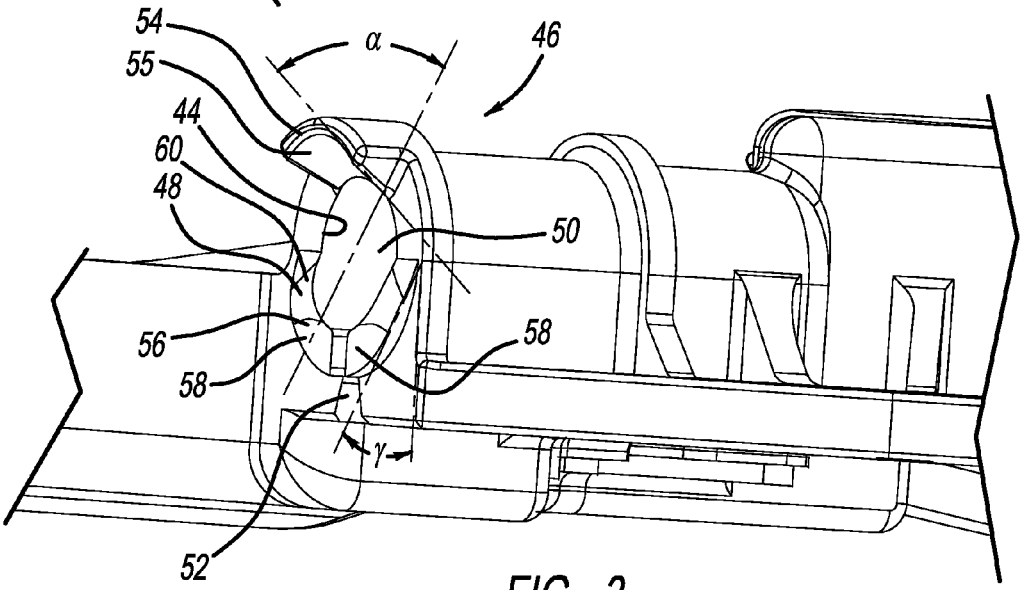
FIG. 3 is a second perspective partial view on a detail of a drive unit housing of the window regulator assembly of FIG. 1.

As best visible in FIGS. 2 and 3, The mouth 44 of the port 46 transitions into a profiled end face 48 extending around the mouth 44 and unitarily formed on the drive unit housing 20. The port 46 forms a cylindrical cavity 50 adapted in size to the circumferential surface 36 of connector 38. A slot 52 extends radially outward from the cylindrical cavity 50, axially along the cylindrical cavity, and through the end face 48. The slot 52 allows for the insertion of the cable wire 22 (not shown in FIGS. 2-5).

Radially opposite the slot 52, the end face 48 forms a radially sloped ramp profile 54 configured to exert a radial bias on the compression spring 42 that surrounds the connector 36 and abuts the end face 48. The ramp profile 54 has a ramp surface 55 slope angle $\alpha$ in the range of about 45° through 80° with respect to a plane extending radially with respect to the cylindrical cavity and thus forms a partial funnel extending around a portion of mouth 44. In the shown example, the ramp profile 54 takes up a circumferential angle $\beta$ of approximately 90°, but would be functional within a range of about 60° through 120°. If the angle $\beta$ becomes too large, the ends of the ramp profile 54 would urge the compression spring 42 in opposite directions so that the function of the funnel shape would be impaired.

The ramp profile 54 has an angular orientation that faces outboard or inboard with respect to the vehicle door. Thus, the radial bias on the spring is exerted in a direction that extends parallel to the movement of the vehicle door during opening and closing.

Although the shown example displays the ramp profile 54 with funnel-shaped ramp surface 55 urging the compression spring 42 radially inward relative to mouth 44, another option is a cone-shaped ramp profile that may wedge itself between the compression spring 42 and the cylindrical surface 38, thereby urging the compression spring 42 radially outward. The principle of either ramp profile is the exertion of an asymmetrical bias on the end of the compression spring 42 that contacts the end face 48 in the direction of the door opening and closing movement, thereby reducing the duration of any vibration. Because the exertion of the bias occurs on the outside of the connector 36, the movability and function of cable wire 22 within the sheath 24 is not affected.

In addition to ramp profile 54, end face 48 further includes an optional wedge profile 56 with an increasing elevation from the mouth 44 along a direction away from the radially sloped ramp profile 54, corresponding to a downward direction in FIGS. 2-5 and to an inboard or outboard direction in a vehicle door. While the term "wedge" is used in this context, the term is intended to include differently shaped protrusions extending from the end face so as to apply a local axial bias on the compression spring 42. The wedge profile 56 exerts an axial bias on the compression spring 42. The wedge profile 56 slants the compression spring by extending only over a limited angular portion of the end face 48. The wedge profile 56 is symmetrically arranged on both sides of the slot 52. Adjacent the slot 52, the wedge profile has a pair of leveled-off areas 58 that extend in a radial plane. In areas more remote from the slot 52, the wedge profile 56 levels off axially toward the mouth 44 in sloped portion 60 at a maximum slope angle $\gamma$ and occupies a total angular range in the circumferential direction of about 180° around the mouth 44. The maximum slope angle $\gamma$ ranges between about 5° and about 30°.

The ramp profile 54 axially protrudes farther from the mouth 44 than the wedge profile 56 and forms a larger angle $\alpha$ with the radial plane than the maximum slope angle $\gamma$ of the wedge profile 56. Accordingly, the ramp profile exerts a bias primarily in the radial direction, while the wedge profile exerts a bias primarily in the axial direction. All angles may be optimized within the ranges based on specifics of the drive unit housing, the connector 36, and the compression spring 42.

Figure 4:
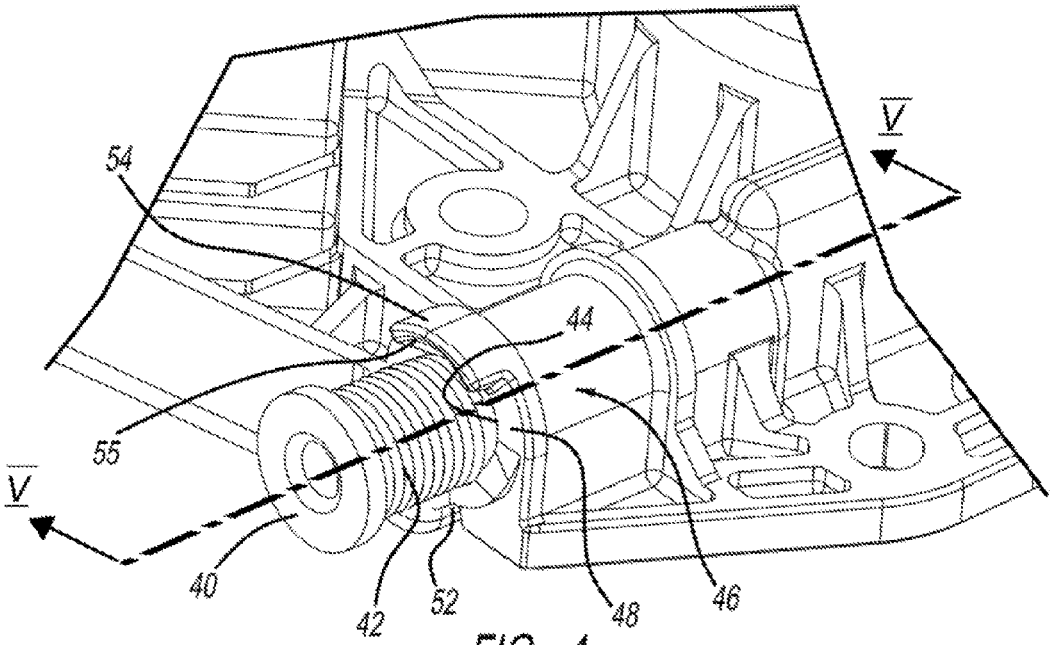
FIG. 4 is a third perspective partial view on a detail of a drive unit housing of the window regulator assembly of FIG. 1 with an inserted cable connector.

The compression spring 42 is shown to have about ten windings, but the number of windings may vary depending on the desired spring characteristics. As shown in FIG. 4, the compression spring 42 has unground ends, but due to the profiled end face 48, the spring ends may be ground or unground, open or closed. With a compression spring having open ends that may be ground or unground, the axial bias of the wedge profile 56 might potentially be achieved by indexing the compression spring to have its end positioned approximately opposite the ramp profile 54. By incorporating the wedge profile 56, such indexing is not necessary.

The port 46 is preferably located at connector 36 of the fixed end 34 of the cable sheath 24 associated with the drive unit housing 20 shown in FIG. 1. Optionally the same profiled end face as on port 46 or a similar profiled end face may be formed on the drive unit housing 20 at the location of connector 36 of cable sheath 28. Because cable sheath 28 extends in a generally straight line, however, rattle mitigation is of lesser importance than for cable sheath 24 because cable sheath 28 can only perform a much smaller pivoting movement than cable sheath 24.

The drive unit housing is made of thermoplastic material and may, for example, be manufactured by injection molding or any other suitable known technique. The profiled end face 48 can thus be formed in one monolithic structure with the drive unit housing 20 and does not require any additional assembly steps.

FIG. 5 illustrates how the ramp profile 54 urges the winding 62 of the compression spring 42 abutting the ramp profile 54 radially inward onto the circumferential cylindrical surface 38 of connector 36, while the wedge profile urges the spring end in the axial direction. Thus the winding 62 has lost its radial degree of freedom and is additionally limited by the wedge profile 56 in its axial mobility. Due to its connection to the remainder of the compression spring 42, reduces rattling of the entire spring 42. The resulting deformation of the spring 42 exerts radial forces on the connector 38, which may result in a slight "cocking" of the connector 38 in the port 46.

In tests, the profiled end face formed on the housing has significantly reduced the duration of any rattling noise caused by the pivoting movement of cable sheath 24 that occurs, for example, when the vehicle door is slammed shut. The duration of the noise has been shortened to such a degree that the noise is perceived as part of the door slamming noise without a continuing perception of rattling.

A person skilled in the art will recognize from the previous description that modifications and changes can be made to the present disclosure without departing from the scope of the invention as defined in the following claims.

What is claimed is:

1. A rattle mitigation assembly for window regulator installed in a vehicle door, comprising a spring cap having a connector having a cylindrical portion and a radial collar, and a compression spring surrounding the cylindrical portion and abutting the radial collar; and a drive unit housing having a port for the spring cap, the port including a mouth of a cylindrical cavity adapted to receive a section of the cylindrical portion; and a profiled end face extending around the mouth, the end face forming a radially sloped ramp along only a portion of the mouth and exerting a radial bias on a portion of the compression spring that abuts the radially sloped ramp.

2. The rattle mitigation assembly according to claim 1, wherein the radially sloped ramp profile extends in a circumferential area of the profiled end face that faces in one of an inboard and an outboard direction of the vehicle door.

3. The rattle mitigation assembly according to claim 1, wherein the ramp has a slope angle in the range of 45° through 80° with respect to a plane extending radially with respect to the cylindrical cavity.

4. The rattle mitigation assembly according to claim 1, wherein the radial bias is a radially inward bias with respect to the cylindrical cavity.

5. The rattle mitigation assembly according to claim 1, wherein the ramp has a ramp surface shaped as a segment of a funnel.

6. The rattle mitigation assembly according to claim 1, wherein the profiled end face further includes a wedge profile exerting an axial bias on a portion of the compression spring that abuts the wedge profile.

7. The rattle mitigation assembly according to claim 6, wherein the wedge profile has an increasing elevation along a direction away from the radially sloped ramp profile.

8. The rattle mitigation assembly according to claim 6, wherein the port further comprises a slot extending radially outward from the cylindrical cavity, along the cylindrical cavity and through the end face, and wherein the wedge profile is symmetrically arranged bilaterally of and adjacent to the slot.

9. The rattle mitigation assembly according to claim 6, wherein the wedge profile extends over an angular range of at most 180°.

10. The rattle mitigation assembly according to claim 6, wherein the wedge profile has a wedge angle in a range of 5° through 30° with respect to a radial plane relative to the cylindrical cavity.

11. A rattle mitigation assembly for window regulator installed in a vehicle door, comprising a spring cap having a connector having a cylindrical portion and a radial collar, and a compression spring surrounding the cylindrical portion and abutting the radial collar; and a drive unit housing having a port for the spring cap, the port including a mouth of a cylindrical cavity adapted to receive a section of the cylindrical portion; and a profiled end face extending around the mouth, the end face forming a radially sloped ramp exerting a radial bias on a portion of the compression spring that abuts the radially sloped ramp, wherein the port further comprises a slot extending radially outward from the cylindrical cavity, along the cylindrical cavity and through the end face.

12. The rattle mitigation assembly according to claim 11, wherein the ramp profile is arranged radially opposite the slot.

13. A rattle mitigation assembly for window regulator installed in a vehicle door, comprising a spring cap having a connector having a cylindrical portion and a radial collar, and a compression spring surrounding the cylindrical portion and abutting the radial collar; and a drive unit housing having a port for the spring cap, the port including a mouth of a cylindrical cavity adapted to receive a section of the cylindrical portion; and a profiled end face extending around the mouth, the end face forming a radially sloped ramp exerting a radial bias on a portion of the compression spring that abuts the radially sloped ramp wherein the ramp extends over an angular range of at most 120° around the mouth.

* * * * *